US010204534B2

(12) United States Patent
Cao et al.

(10) Patent No.: US 10,204,534 B2
(45) Date of Patent: Feb. 12, 2019

(54) TRANSPARENT DISPLAY APPARATUS

(71) Applicant: BOE TECHNOLOGY GROUP CO., LTD., Beijing (CN)

(72) Inventors: Lei Cao, Beijing (CN); Guanshan Tong, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/656,853

(22) Filed: Jul. 21, 2017

(65) Prior Publication Data

US 2018/0061284 A1 Mar. 1, 2018

(30) Foreign Application Priority Data

Aug. 31, 2016 (CN) ..... 2016 2 1028348 U

(51) Int. Cl.

| | |
|---|---|
| ***F21V 7/04*** | (2006.01) |
| ***G09F 13/18*** | (2006.01) |
| ***G09F 13/00*** | (2006.01) |
| ***G09F 13/22*** | (2006.01) |
| ***G09F 9/33*** | (2006.01) |

(52) U.S. Cl.

CPC ..... *G09F 13/18* (2013.01); *G09F 9/33* (2013.01); *G09F 13/005* (2013.01); *G09F 13/22* (2013.01); *G09F 2013/1881* (2013.01); *G09F 2013/222* (2013.01)

(58) Field of Classification Search

CPC ..... G09F 13/00; G09F 13/005; G09F 13/02; G09F 13/04; G09F 13/18; G09F 13/22; G09F 2013/049; G09F 2013/1804–2013/1895; G09F 2013/222

USPC ..... 362/612, 631–634

See application file for complete search history.

(56) References Cited

U.S. PATENT DOCUMENTS

| | | | | |
|---|---|---|---|---|
| 5,526,245 A * | 6/1996 | Davis | F21S 8/026 | 362/233 |
| 9,038,301 B2 * | 5/2015 | Zelbacher | A47G 1/0622 | 40/790 |
| 2015/0228211 A1 * | 8/2015 | Curic | G09F 13/0413 | 40/541 |

* cited by examiner

*Primary Examiner* — Jason M Han

(74) *Attorney, Agent, or Firm* — Kinney & Lange, P.A.

(57) ABSTRACT

Embodiments of the present disclosure disclose a transparent display apparatus. The transparent display apparatus includes a transparent display module, a light source assembly, a back frame and a front frame. The back frame and the front frame are disposed opposite to each other and are fixed to each other, and an annular accommodation groove is formed between the back frame and the front frame. An edge of the transparent display module is embedded in the accommodation groove, and is fixed to the back frame and the front frame, respectively, and at least a part of a side surface of the transparent display module serves as a light entering surface for the transparent display module displaying a picture. The light source assembly is located in the accommodation groove, and has a luminous element which is just opposite to the light entering surface.

17 Claims, 3 Drawing Sheets

TRANSPARENT DISPLAY APPARATUS

CROSS-REFERENCE TO RELATED APPLICATION

This application claims the benefit of Chinese Patent Application No. 201621028348.2 filed on Aug. 31, 2016, the whole disclosure of which is incorporated herein by reference.

BACKGROUND

1. Technical Field

Embodiments of the present disclosure relate to a transparent display apparatus.

2. Description of the Related Art

Generally, a transparent display apparatus is a display apparatus that can assume a transparent state so that a viewer can see a scene behind the display apparatus. The transparent display apparatus may be used in locations where material objects behind the transparent display apparatus need to be exhibited, such as a shop window, a glass curtain wall and the like.

SUMMARY

Embodiments of the present disclosure provide a transparent display apparatus comprising: a transparent display module, a light source assembly, a back frame and a front frame, wherein:

the back frame and the front frame are disposed opposite to each other and are fixed to each other, and an annular accommodation groove is formed between the back frame and the front frame, an edge of the transparent display module is embedded in the accommodation groove, and is fixed to the back frame and the front frame, respectively, and at least a part of a side surface of the transparent display module serves as a light entering surface for the transparent display module displaying a picture, such that light enters the transparent display module from the light entering surface and exits through a display surface of the transparent display module so that the transparent display module displays the picture, and the light source assembly is located in the accommodation groove, and has a luminous element which is just opposite to the light entering surface.

According to embodiments of the present disclosure, the back frame and the front frame each have an L-shaped section along a direction perpendicular to the display surface of the transparent display module, the back frame comprises a first part and a second part, the front frame comprises a third part and a fourth part, the second part of the back frame is opposite to the fourth part of the front frame, the first part of the back frame is fixed to the third part of the front frame, the first part of the back frame is located inside the third part of the front frame, and the light source assembly is fixed to the first part of the back frame.

According to embodiments of the present disclosure, the transparent display module is an optical waveguide display module.

According to embodiments of the present disclosure, the transparent display module has a rectangular section along a direction parallel to the display surface of the transparent display module, and one of side surfaces of the transparent display module serves as the light entering surface for the transparent display module displaying the picture.

According to embodiments of the present disclosure, the light source assembly is an LED strip light.

According to embodiments of the present disclosure, the transparent display apparatus further comprises: a mounting frame formed with mounting grooves, wherein both the front frame and the back frame are embedded in the mounting grooves.

According to embodiments of the present disclosure, the mounting frame comprises two first borders and two second borders which are respectively formed with the mounting grooves, the two first borders are disposed in parallel with and opposite to each other, the two second borders are disposed in parallel with and opposite to each other, both ends of each of the two first borders are provided with protrusions, respectively, the protrusion of one of the ends of each of the two first borders is inserted in the mounting groove of one of the two second borders, and the protrusion of the other of the ends of each of the two first borders is inserted in the mounting groove of the other of the two second borders.

According to embodiments of the present disclosure, the transparent display apparatus further comprises: a control circuit board located outside the mounting frame and connected to the transparent display module.

According to embodiments of the present disclosure, the transparent display apparatus further comprises: a shield cover plate covering the control circuit board.

According to embodiments of the present disclosure, the transparent display apparatus is adapted to be mounted to a mounting wall, and the mounting wall is formed with a circuit board accommodating groove in which the control circuit board and the shield cover plate are fixed.

DETAILED DESCRIPTION OF THE EMBODIMENTS

Figure 1:
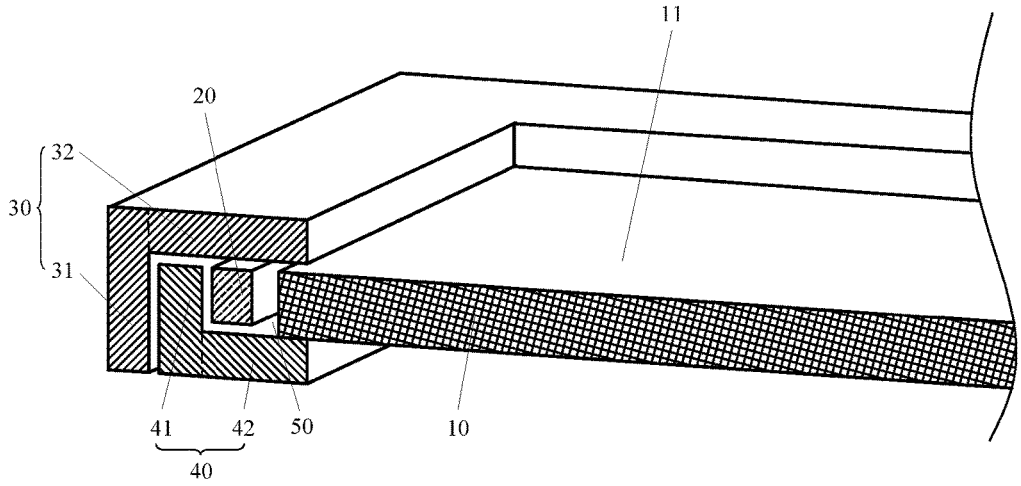
FIG. 1 is a schematic view showing a structure of a transparent display apparatus according to an embodiment of the present disclosure.

A further description of the disclosure will be made in detail as below with reference to embodiments of the present disclosure taken in conjunction with the accompanying drawings. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In order to further describe a transparent display apparatus according to embodiments of the present disclosure, a further description of the transparent display apparatus will be made in detail as below with reference to the accompanying drawings.

Referring to FIG. 1, the transparent display apparatus according to the embodiments of the present disclosure comprises: a transparent display module 10, a light source assembly 20, a back frame 40 and a front frame 30. The back frame 40 and the front frame 30 are disposed opposite to each other and are fixed to each other, and an annular accommodation groove 50 is formed between the back frame 40 and the front frame 30. An edge of the transparent display module 10 is embedded in the accommodation groove 50, and is fixed to the back frame 40 and the front frame 30, respectively. A side surface of the transparent display module 10 is located in the accommodation groove 50. At least a part of the side surface of the transparent display module 10 serves as a light entering surface for the transparent display module 10 displaying a picture, such that light enters the transparent display module 10 from the light entering surface and exits through a display surface 11 of the transparent display module 10 so that the transparent display module 10 displays the picture. The light source assembly 20 is located in the accommodation groove 50, and has a luminous element which is just opposite to the light entering surface.

For example, a transparent display apparatus having a rectangular section along a direction parallel to the display surface 11 of the transparent display module 10 is taken as an example for description. Referring to FIG. 1, the front frame 30 and the back frame 40 each have an annular shape and are disposed around the transparent display module 10. The front frame 30 is located on a front side of the transparent display module 10 where the display surface 11 is located, while the back frame 40 is located on a back side of the transparent display module 10. For example, as shown in FIG. 1, the display surface 11 of the transparent display module 10 is an upper surface of the transparent display module 10 in FIG. 1, while a back surface of the transparent display module 10 is a lower surface of the transparent display module 10 in FIG. 1. The front frame 30 is located on an upper side of the transparent display module 10 in FIG. 1, while the back frame 40 is located on a lower side of the transparent display module 10 in FIG. 1. The front frame 30 and the back frame 40 are disposed opposite to each other and are fixed to each other, and the annular accommodation groove 50 is formed between the front frame 30 and the back frame 40. The edge of the transparent display module 10 is embedded in the accommodation groove 50, and is fixed to the front frame 30 and the back frame 40, respectively. All of side surfaces of the transparent display module 10 are located in the accommodation groove 50. At least some of the side surfaces of the transparent display module 10 serve as the light entering surface for the transparent display module 10 displaying the picture. Specifically, as shown in FIG. 1, the transparent display module 10 has four edges embedded in the accommodation groove 50; and the transparent display module 10 also has four side surfaces at least one of which serves as the light entering surface for the transparent display module 10 displaying the picture. The light source assembly 20 is disposed in the accommodation groove 50. The light source assembly 20 may be mounted to the front frame 30 or the back frame 40, and the luminous element of the light source assembly 20 is just opposite to the light entering surface. For example, as shown in FIG. 1, the light source assembly 20 is disposed in the accommodation groove 50 on the left side in FIG. 1, and a left edge of the transparent display module 10 is embedded in the accommodation groove 50 on the left side in FIG. 1. A left side surface of the transparent display module 10 is located in the accommodation groove 50, and serves as the light entering surface. Therefore, the luminous element of the light source assembly 20 is just opposite to the left side surface of the transparent display module 10. Light emitted by the luminous element of the light source assembly 20 enters the transparent display module 10 through the light entering surface of the transparent display module 10 and then exits through the display surface 11 of the transparent display module 10 so that the transparent display module 10 and thus the transparent display apparatus display the picture.

In the transparent display apparatus according to the embodiments of the present disclosure, light enters the transparent display module 10 from the light entering surface and exits through the display surface 11 of the transparent display module 10 so that a picture can be displayed. The transparent display apparatus according to the embodiments of the present disclosure looks integration in appearance just by assembling the light source assembly 20 and the transparent display module 10 together through the front frame 30 and the back frame 40, thereby achieving a good assembling effect. Compared with a conventional transparent display apparatus, the transparent display apparatus according to the embodiments of the present disclosure has fewer components so that an assembling process of the transparent display apparatus can be simplified, thereby facilitating assembling of the transparent display apparatus.

Since the transparent display apparatus according to the embodiments of the present disclosure has fewer components so that the assembling process of the transparent display apparatus can be simplified, thereby facilitating assembling of the transparent display apparatus. As a result, an efficiency of assembling of the transparent display apparatus can be improved, time expended in assembling the transparent display apparatus can be saved, and thus a production cost of the transparent display apparatus can be reduced.

The transparent display apparatus according to the embodiments of the present disclosure may be mounted to a wall to serve as a glass curtain wall. In this case, a mounting wall for mounting the transparent display apparatus may be a wall. The transparent display apparatus may also be mounted to an electric apparatus such as a washing machine, a refrigerator, and the like. Thereby, while the transparent display apparatus displays some information, a state inside the electric apparatus can also be seen through the transparent display apparatus. In this case, the mounting wall for mounting the transparent display apparatus may be a front panel of the washing machine, or a front door of the refrigerator. The transparent display apparatus may also be mounted to furniture such as a cabinet and the like. Thereby, while the transparent display apparatus functions as decoration, it may also serve as a TV and a display screen of a computer. In this case, the mounting wall for mounting the transparent display apparatus may be a cabinet door.

Referring to FIG. 1, in embodiments of the present disclosure, the back frame 40 and the front frame 30 each have an L-shaped section along a direction perpendicular to the display surface 11 of the transparent display module 10.

The back frame 40 comprises a first part 41 and a second part 42, while the front frame 30 comprises a third part 31 and a fourth part 32. The second part 42 of the back frame 40 is opposite to the fourth part 32 of the front frame 30, the first part 41 of the back frame 40 is fixed to the third part 31 of the front frame 30, and the first part 41 of the back frame 40 is located inside the third part 31 of the front frame 30. The light source assembly 20 is disposed on the first part 41 of the back frame 40.

Specifically, referring to FIG. 1, the back frame 40 comprises the first part 41 and the second part 42 which are fixed to each other, and the section of the back frame 40 along the direction perpendicular to the display surface 11 of the transparent display module 10 has an L shape. The first part 41 constitutes one of straight parts of the L shape, and the second part 42 constitutes the other of the straight parts of the L shape. The front frame 30 comprises the third part 31 and the fourth part 32 which are fixed to each other, and the section of the front frame 30 along the direction perpendicular to the display surface 11 of the transparent display module 10 has an L shape. The third part 31 constitutes one of straight parts of the L shape, and the fourth part 32 constitutes the other of the straight parts of the L shape.

As shown in FIG. 1, the first part 41 of the back frame 40 is located on a left side of the second part 42 of the back frame 40, and the third part 31 of the front frame 30 is located on a left side of the fourth part 32 of the front frame 30. Further, a left surface of the first part 41 of the back frame 40 is fixed to a right surface of the third part 31 of the front frame 30, and the second part 42 of the back frame 40 is opposite to the fourth part 32 of the front frame 30. The second part 42 of the back frame 40 and the fourth part 32 of the front frame 30 constitute sidewalls of the accommodation groove 50, and a right surface of the first part 41 of the back frame 40 serves as a groove bottom of the accommodation groove 50. The light source assembly 20 may be fixed to the right surface of the first part 41 of the back frame 40. In other words, the light source assembly 20 may be fixed to the groove bottom of the accommodation groove 50.

When the transparent display apparatus is assembled, the back frame 40 is first placed on an assembling table, and then the light source assembly 20 is fixed to an inner surface of the first part 41 of the back frame 40. After that, the transparent display module 10 is placed on the back frame 40, while the display surface 11 of the transparent display module 10 faces upwards and an edge of a back surface of the transparent display module 10 abuts against and is fixed to an upper surface of the second part 42 of the back frame 40. Next, the front frame 30 is placed on the back frame 40 in such a way that the third part 31 of the front frame 30 is located outside the back frame 40. In other words, the third part 31 of the front frame 30 surrounds the back frame 40, and abuts against and is fixed to a surface of the first part 41 of the back frame 40 facing away from the second part 42 of the back frame 40. The third part 31 of the front frame 30 is located outside the first part 41 of the back frame 40, and a lower surface of the fourth part 32 of the front frame 30 is in contact with and is fixed to an edge of the display surface 11 of the transparent display module 10. Thereby, the assembling of the transparent display apparatus is completed.

The front frame 30 and the back frame 40 according to the embodiments are utilized to assemble the light source assembly 20 and the transparent display module 10 together, so that the assembling process of the transparent display apparatus can be further simplified, thereby facilitating assembling of the transparent display apparatus.

In the abovementioned embodiments, the side surface of the transparent display module 10 serves as the light entering surface for the transparent display module 10 displaying the picture. For example, the transparent display module 10 may be an optical waveguide display module. The optical waveguide display module has a high light utilization ratio and a good displaying effect. Therefore, the transparent display apparatus with the optical waveguide display module also has a high light utilization ratio and a good displaying effect. In addition, generally, the optical waveguide display module has a good transmittance. Therefore, the transparent display apparatus with the optical waveguide display module also has a good transmittance.

In the embodiments, the section of the transparent display module 10 along the direction parallel to the display surface 11 of the transparent display module 10 may have various shapes, such as a rectangular shape, a triangular shape, a circular shape, a polygonal shape, and the like.

In the embodiments of the present disclosure, the section of the transparent display module 10 along the direction parallel to the display surface 11 of the transparent display module 10 has the rectangular shape. The transparent display module 10 has four side surfaces. One of the four side surfaces may serve as the light entering surface for the transparent display module 10 displaying the picture. In this case, the light source assembly 20 is disposed in the accommodation groove 50 corresponding to the one of the four side surfaces. Alternatively, two of the four side surfaces may serve as the light entering surface for the transparent display module 10 displaying the picture. In this case, the light source assemblies 20 are disposed in the accommodation grooves 50 respectively corresponding to the two of the four side surfaces, respectively. Still alternatively, three of the four side surfaces may serve as the light entering surface for the transparent display module 10 displaying the picture. In this case, the light source assemblies 20 are disposed in the accommodation grooves 50 respectively corresponding to the three of the four side surfaces, respectively. Yet alternatively, all of the four side surfaces may serve as the light entering surface for the transparent display module 10 displaying the picture. In this case, the light source assemblies 20 in the accommodation grooves 50 are disposed around the transparent display module 10.

The light source assembly 20 may be a light tube such as a fluorescent tube, a panel light such as an LED panel light, or a strip light such as an LED strip light.

Figure 2:
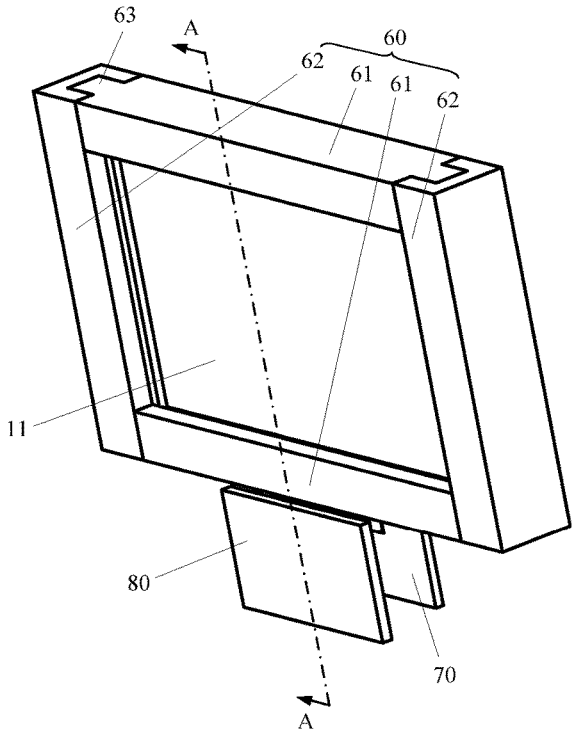
FIG. 2 is another schematic view showing the structure of the transparent display apparatus according to the embodiment of the present disclosure.
Figure 3:
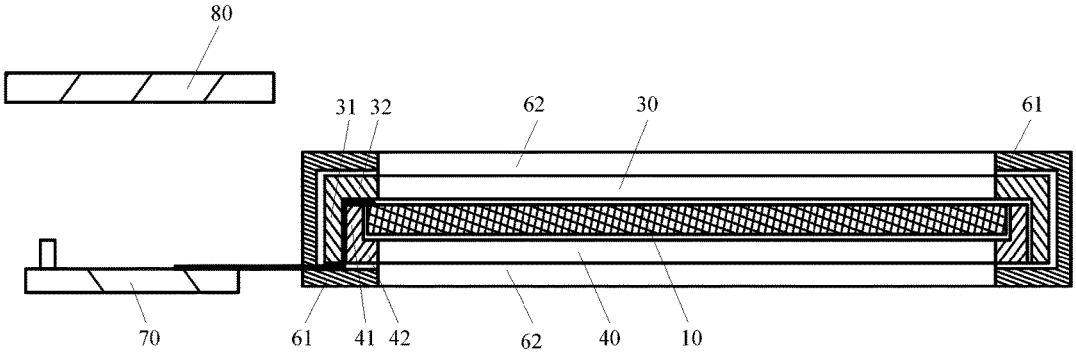
FIG. 3 is a schematic sectional view taken along line A-A in FIG. 2.

Referring to FIG. 2 and FIG. 3, the transparent display apparatus according to the embodiments of the present disclosure further comprises a mounting frame 60 formed with mounting grooves. Both the front frame 30 and the back frame 40 are embedded in the mounting grooves. With such a design, when the transparent display apparatus according to the embodiments of the present disclosure is mounted to a wall, an electric apparatus, a furniture, or the like, the mounting frame 60 is in direct contact with the wall, the electric apparatus, the furniture, or the like. Therefore, the front frame 30 and the back frame 40 and thus the transparent display module 10 can be protected.

Referring to FIG. 2 and FIG. 3, the mounting frame 60 comprises two first borders 61 and two second borders 62 which are respectively formed with the mounting grooves. The two first borders 61 are disposed in parallel with and opposite to each other, and the two second borders 62 are disposed in parallel with and opposite to each other. Both ends of each of the two first borders 61 are provided with protrusions 63, respectively. The protrusion 63 of one of the ends of each of the two first borders 61 is inserted in the mounting groove of one of the two second borders 62, and the protrusion 63 of the other of the ends of each of the two first borders 61 is inserted in the mounting groove of the other of the two second borders 62. The two first borders 61 and the two second borders 62 constitute the annular mounting frame 60.

Referring to FIG. 2 and FIG. 3, the transparent display apparatus according to the embodiments of the present disclosure further comprises a control circuit board 70 located outside the mounting frame 60 and connected to the transparent display module 10. Specifically, a through hole may be formed in the mounting frame 60. For example, the through hole may be formed in the first border 61 located on the lower side in FIG. 2. The control circuit board 60 is connected to the transparent display module 10 through the through hole. Compared with disposing of the control circuit board 70 inside the mounting frame 60, disposing of the control circuit board 70 outside the mounting frame 60 can avoid an increased space occupied by the transparent display apparatus since the control circuit board 70 occupies a space inside the mounting frame 60.

Figure 4:
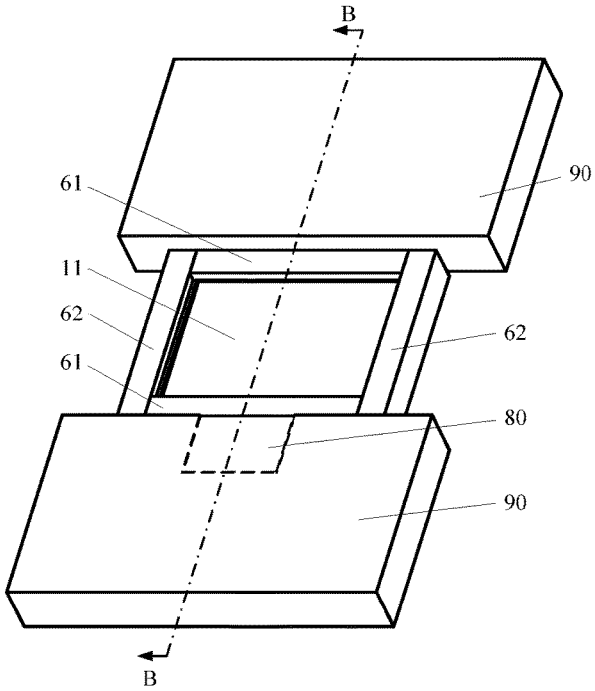
FIG. 4 is a schematic view of the transparent display apparatus according to the embodiments of the present disclosure in the case where it is mounted to a wall.
Figure 5:
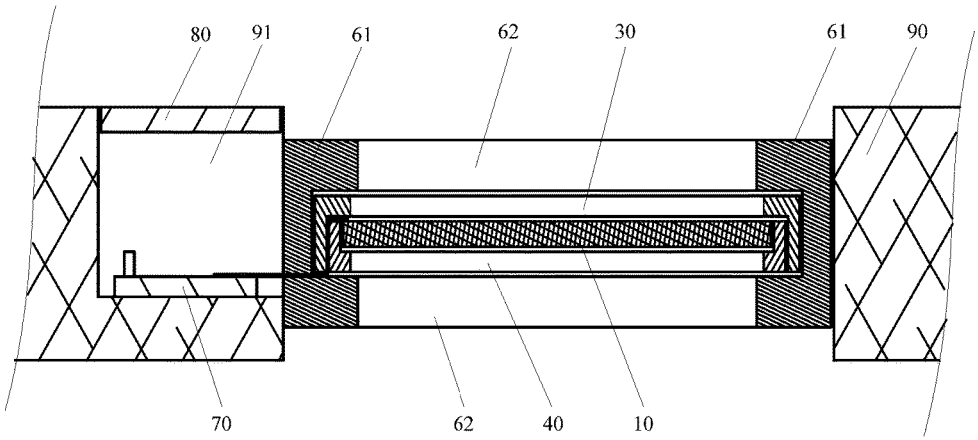
FIG. 5 is a schematic sectional view taken along line B-B in FIG. 4.

A description will be made as below with reference to an example in which the transparent display apparatus is mounted to a wall. In this case, the mounting wall for mounting the transparent display apparatus is a wall. Referring to FIG. 4 and FIG. 5, if the transparent display apparatus is mounted to a wall 90, the wall 90 may be formed with a circuit board accommodating groove 91. The mounting frame 60 of the transparent display apparatus is in direct contact with and is fixed to the wall 90. The control circuit board 70 of the transparent display apparatus is placed in the circuit board accommodating groove 91 of the wall 90 and is fixed to a groove wall of the circuit board accommodating groove 91. By forming the circuit board accommodating groove 91 in the wall 90 and placing the control circuit board 70 in the circuit board accommodating groove 91, the control circuit board 70 can be hidden, thereby increasing aesthetic property in appearance.

Referring to FIG. 2 and FIG. 3, the transparent display apparatus according to the embodiments of the present disclosure further comprises a shield cover plate 80 covering the control circuit board 70. If the transparent display apparatus is mounted to the wall 90, referring to FIG. 4 and FIG. 5, the wall 90 is formed with the circuit board accommodating groove 91. The control circuit board 70 of the transparent display apparatus is placed in the circuit board accommodating groove 91 of the wall 90 and is fixed to the groove wall of the circuit board accommodating groove 91. The shield cover plate 80 is also placed in the circuit board accommodating groove 91 of the wall 90 and covers the control circuit board 70. The shield cover plate 80 may be fixed to another groove wall of the circuit board accommodating groove 91, which is opposite to or adjacent to the groove wall to which the control circuit board 70 is fixed, inside the circuit board accommodating 91. By providing the shield cover plate 80, the shield cover plate 80 can shield radiation of the control circuit board 70 when it transmits a signal, and protects the control circuit board 70.

The embodiments of the present disclosure provide a transparent display apparatus, thereby simplifying an assembling process of the transparent display apparatus.

In the transparent display apparatus according to the embodiments of the present disclosure, light enters the transparent display module from the light entering surface and exits through the display surface of the transparent display module so that a picture can be displayed. The transparent display apparatus according to the embodiments of the present disclosure looks integration in appearance just by assembling the light source assembly and the transparent display module together through the front frame and the back frame, thereby achieving a good assembling effect. Compared with a conventional transparent display apparatus, the transparent display apparatus according to the embodiments of the present disclosure has fewer components so that an assembling process of the transparent display apparatus can be simplified, thereby facilitating assembling of the transparent display apparatus.

The above disclosed embodiments are only used to explain the present invention, and should not be construed to limit the present invention. It will be appreciated by those skilled in the art that various changes and modifications may be made therein without departing from the spirit of the present invention, the scope of which is defined in the appended claims and their equivalents.

What is claimed is:

1. A transparent display apparatus comprising:

a transparent display module, a light source assembly, a one-piece annular back frame and a one-piece annular front frame, wherein:

the one-piece annular back frame and the one-piece annular front frame are disposed opposite to each other and are fixed to each other, and an annular accommodation groove is formed between the one-piece annular back frame and the one-piece annular front frame, an edge of the transparent display module is embedded in the accommodation groove, and is fixed to the one-piece annular back frame and the one-piece annular front frame, respectively, and at least a part of a side surface of the transparent display module serves as a light entering surface for the transparent display module displaying a picture, such that light enters the transparent display module from the light entering surface and exits through a display surface of the transparent display module so that the transparent display module displays the picture, the light source assembly is located in the accommodation groove, and has a luminous element which is just opposite to the light entering surface, and the one-piece annular back frame and the one-piece annular front frame each have an L-shaped section along a direction perpendicular to the display surface of the transparent display module, the one-piece annular back frame comprises an annular first part and an annular second part, the one-piece annular front frame comprises an annular third part and an annular fourth part such that the one-piece annular back frame is capable of being placed inside the annular third part of the one-piece annular front frame, the second part of the one-piece annular back frame is opposite to the fourth part of the one-piece annular front frame, the first part of the one-piece annular back frame is fixed to the third part of the one-piece annular front frame, and the first part of the one-piece annular back frame is located inside the third part of the one-piece annular front frame.

2. The transparent display apparatus of claim 1, wherein:

the light source assembly is fixed to the first part of the one-piece annular back frame.

3. The transparent display apparatus of claim 1, wherein:

the transparent display module comprises an optical waveguide display module.

4. The transparent display apparatus of claim 1, wherein:

the transparent display module has a rectangular section along a direction parallel to the display surface of the transparent display module, and the side surface of the transparent display module serves as the light entering surface for the transparent display module displaying the picture.

5. The transparent display apparatus of claim 1, wherein:

the light source assembly comprises an LED strip light.

6. The transparent display apparatus of claim 1, further comprising:

a mounting frame formed with mounting grooves, wherein both the front frame and the back frame are embedded in the mounting grooves.

7. The transparent display apparatus of claim 6, further comprising:

a control circuit board located outside the mounting frame and connected to the transparent display module.

8. The transparent display apparatus of claim 7, further comprising:

a shield cover plate covering the control circuit board.

9. The transparent display apparatus of claim 8, wherein:

the transparent display apparatus is adapted to be mounted to a mounting wall, and the mounting wall is formed with a circuit board accommodating groove in which the control circuit board and the shield cover plate are fixed.

10. A transparent display apparatus comprising:

a transparent display module, a light source assembly, a back frame and a front frame, wherein:

the back frame and the front frame are disposed opposite to each other and are fixed to each other, and an annular accommodation groove is formed between the back frame and the front frame, an edge of the transparent display module is embedded in the accommodation groove, and is fixed to the back frame and the front frame, respectively, and at least a part of a side surface of the transparent display module serves as a light entering surface for the transparent display module displaying a picture, such that light enters the transparent display module from the light entering surface and exits through a display surface of the transparent display module so that the transparent display module displays the picture, the light source assembly is located in the accommodation groove, and has a luminous element which is just opposite to the light entering surface, the transparent display apparatus further comprises a mounting frame formed with mounting grooves, wherein both the front frame and the back frame are embedded in the mounting grooves, the mounting frame comprises two first borders and two second borders which are respectively formed with the mounting grooves, and the two first borders are disposed in parallel with and opposite to each other, the two second borders are disposed in parallel with and opposite to each other, both ends of each of the two first borders are provided with protrusions, respectively, the protrusion of one of the ends of each of the two first borders is inserted in the mounting groove of one of the two second borders, and the protrusion of the other of the ends of each of the two first borders is inserted in the mounting groove of the other of the two second borders.

11. The transparent display apparatus of claim 10, wherein:

the back frame and the front frame each have an L-shaped section along a direction perpendicular to the display surface of the transparent display module, the back frame comprises a first part and a second part, the front frame comprises a third part and a fourth part, the second part of the back frame is opposite to the fourth part of the front frame, the first part of the back frame is fixed to the third part of the front frame, and the first part of the back frame is located inside the third part of the front frame, and the light source assembly is fixed to the first part of the back frame.

12. The transparent display apparatus of claim 10, wherein:

the transparent display module comprises an optical waveguide display module.

13. The transparent display apparatus of claim 10, wherein:

the transparent display module has a rectangular section along a direction parallel to the display surface of the transparent display module, and the side surface of the transparent display module serves as the light entering surface for the transparent display module displaying the picture.

14. The transparent display apparatus of claim 10, wherein:

the light source assembly comprises an LED strip light.

15. The transparent display apparatus of claim 10, further comprising:

a control circuit board located outside the mounting frame and connected to the transparent display module.

16. The transparent display apparatus of claim 15, further comprising:

a shield cover plate covering the control circuit board.

17. The transparent display apparatus of claim 16, wherein:

the transparent display apparatus is adapted to be mounted to a mounting wall, and the mounting wall is formed with a circuit board accommodating groove in which the control circuit board and the shield cover plate are fixed.

* * * * *